US010231287B2

(12) United States Patent
Ploshikhin et al.

(10) Patent No.: US 10,231,287 B2
(45) Date of Patent: Mar. 12, 2019

(54) ELECTRICAL HEATING DEVICE, COMPONENT AND METHOD FOR THE PRODUCTION THEREOF

(71) Applicants: UNIVERSITAT BREMEN (BCCMS), Bremen (DE); NEUE MATERIALIEN BAYREUTH GMBH, Bayreuth (DE); FUTURECARBON GMBH, Bayreuth (DE)

(72) Inventors: Vasily Ploshikhin, Bayreuth (DE); Andrey Prihodovsky, Bayreuth (DE); Walter Schutz, Weidenberg (DE); Stefan Forero, Weidenberg (DE); Alexander Ilin, Bindlach (DE); Helmut Bleier, Bischofsgrun (DE)

(73) Assignees: UNIVERSITAT BREMEN (BCCMS), Bremen (DE); NEUE MATERIALIEN BAYREUTH GMBH, Weidenberg (DE); FUTURECARBON GMBH, Bayreuth (DE)

( * ) Notice: Subject to any disclaimer, the term of this patent is extended or adjusted under 35 U.S.C. 154(b) by 847 days.

(21) Appl. No.: 14/395,423

(22) PCT Filed: Apr. 19, 2013

(86) PCT No.: PCT/EP2013/001172
§ 371 (c)(1),
(2) Date: Feb. 9, 2015

(87) PCT Pub. No.: WO2013/156162
PCT Pub. Date: Oct. 24, 2013

(65) Prior Publication Data

US 2015/0189699 A1 Jul. 2, 2015

(30) Foreign Application Priority Data

Apr. 20, 2012 (DE) ..... 10 2012 007 945

(51) Int. Cl.
*H05B 3/03* (2006.01)
*C23C 4/12* (2016.01)
(Continued)

(52) U.S. Cl.
CPC ..... *H05B 3/03* (2013.01); *C23C 4/131* (2016.01); *H05B 3/145* (2013.01); *H05B 3/22* (2013.01);
(Continued)

(58) Field of Classification Search
CPC ..... H05B 3/34; H05B 2203/013; H05B 2203/017; H05B 2214/04; H05B 3/145;
(Continued)

(56) References Cited

U.S. PATENT DOCUMENTS 3,109,228 A 11/1963 Dyke et al.
7,132,628 B2 * 11/2006 Ptasienski ..... H05B 3/26 219/219
(Continued)

FOREIGN PATENT DOCUMENTS

CN 101400192 4/2009
CN 101636007 A 1/2010
(Continued)

OTHER PUBLICATIONS

English translation of the Japanese Decision of Rejection dated Oct. 31, 2016.
(Continued)

*Primary Examiner* — Dana Ross
*Assistant Examiner* — Kuangyue Chen
(74) *Attorney, Agent, or Firm* — Dilworth IP, LLC

(57) ABSTRACT

An electric heating device (20) is described which has at least one first electrically conductive component (21), at least one heating layer (22) and at least one second electrically conductive component (23). According to the inven-
(Continued)

tion, it is envisaged that the first electrically conductive component (21) and/or the second electrically conductive component (23) is/are produced and/or arranged on the heating layer (22) by means of a thermal spraying process. Alternatively or additionally, according to the invention, it is envisaged that the electrically conductive components (21, 23) and the heating layer (22) are arranged with respect to one another in such a way that a current flow perpendicularly to the plane of the heating layer (22) and/or in the direction of the plane of the heating layer (22) is realized or can be realized. In order to produce an assembly (10), such a heating device (20) can preferably be arranged on a substrate element (11). Furthermore, a suitable production method is described.

10 Claims, 13 Drawing Sheets

(51) Int. Cl.

| | |
|---|---|
| ***H05B 3/22*** | (2006.01) |
| ***H05B 3/14*** | (2006.01) |
| ***H05B 3/34*** | (2006.01) |
| ***C23C 4/131*** | (2016.01) |

(52) U.S. Cl.
CPC ..... *H05B 3/34* (2013.01); *H05B 2203/013* (2013.01); *H05B 2203/017* (2013.01); *H05B 2214/04* (2013.01); *Y10T 29/49083* (2015.01)

(58) Field of Classification Search
CPC .. H05B 3/22; H05B 3/03; C23C 4/131; Y10T 29/49083
USPC ..... 219/541; 29/611
See application file for complete search history.

(56) References Cited

U.S. PATENT DOCUMENTS

| | | | | |
|---|---|---|---|---|
| 7,800,021 | B2 * | 9/2010 | Pilavdzic | C23C 28/321 219/212 |
| 2009/0001066 | A1 * | 1/2009 | Pilavdzic | C23C 28/321 219/385 |
| 2011/0272392 | A1 * | 11/2011 | Dohring | F24D 13/024 219/213 |
| 2012/0118873 | A1 | 5/2012 | Erismis et al. | |

FOREIGN PATENT DOCUMENTS

| | | | | |
|---|---|---|---|---|
| DE | 102009034307 | A1 | 1/2011 | |
| GB | 2344042 | A | 5/2000 | |
| JP | S62-186487 | A | 8/1987 | |
| JP | H07-85957 | A | 3/1995 | |
| JP | 2009218242 | A | 9/2009 | |
| WO | 9851127 | A1 | 11/1998 | |
| WO | 0143506 | A1 | 6/2001 | |
| WO | 01/89265 | A | 11/2001 | |
| WO | 0189265 | A1 | 11/2001 | |
| WO | WO 0189265 | A1 * | 11/2001 | H01C 17/06533 |
| WO | 2007089118 | A1 | 8/2007 | |
| WO | 2012159608 | A2 | 11/2012 | |

OTHER PUBLICATIONS

"Official Action" dated Dec. 22, 2015 issued by the Japanese Patent Office in corresponding JP Application No. 2015-506123, along with unofficiai English translation.
Chinese Office Action dated Apr. 25, 2016 and Search Report from corresponding CN Application No. 201380033003.9, along with unofficial English translation.
Search Report in CN 201380033003 (publication CN104584681) issued by SIPO dated Sep. 22, 2015.
International Search Report mailed in PCT/EP2013/001172 by the ISA/EP dated Jul. 11, 2013.
International Preliminary Report on Patentability/Written Opinion mailed in PCT/EP2013/001172 by the IB/WIPO dated Oct. 21, 2014.

* cited by examiner

ELECTRICAL HEATING DEVICE, COMPONENT AND METHOD FOR THE PRODUCTION THEREOF

The present invention firstly relates to an electric heating device. The present invention also relates to an assembly with an electric heating device and to a method for producing an electric heating device and/or an assembly.

At present there are a whole series of producers and suppliers of heating technologies for two-dimensional applications in the market. The application areas of electric panel heaters are very varied and include in their extent the industrial areas of automotive, medical and electrical engineering. Panel heaters are also used in the area of domestic engineering, for example as wall or floor heating.

The heating systems that are currently used as standard are generally layable heating films or heating wires. In the first case, usually polyester films are coated with carbon pastes by means of standard printing processes, Cu-contact traces being rolled on with a specific spacing along the film webs and the whole unit being encapsulated by lamination. The flexible material can in part be obtained as roll stock. Heating films are relatively easy to produce, but the limitation to rectangular surface areas and the difficulty of being able to heat complexly curved surface areas have disadvantageous effects.

Heating wires are normally laid in a meandering form, so that they fill the surface area to be heated. This gives rise to the possibility of being able to heat any desired surface areas, even complexly curved/shaped areas, relatively homogeneously by skillful laying of the wire. One disadvantage is that each new area geometry requires a separate design.

The great disadvantage of the methods mentioned lies in the kind of current flow. Both in the case of heating films and in the case of systems based on heating wires, the current flow through the heating layer or the heating wires takes place serially, that is to say in a kind of series circuit. In the case of a heating system based on a heating wire, this means complete failure of the heating system in the event of damage to the heating wire, for instance rupture. In the case of heating films, this kind of current flow causes a considerable restriction of the geometries that can be realized with the heating system. The length of the current path must be kept constant over the entire heating area of the heating system, since otherwise inhomogeneities occur in the temperature distribution. This means that, with heating films, only simple geometries, generally rectangular, can be realized, or the realization of more complex geometries involves a considerable design effort.

There are also film-like heating systems in which the current flow takes place as in the case of the present invention perpendicularly to the thickness of the heating layer, that is to say the heating system is formed as a kind of parallel circuit. However, these heating systems are only suitable for use on less curved, two-dimensional surface areas. In the case of the existing heating systems mentioned, the contacting of the heating layer consists of thin metal films.

The technical problem underlying the present invention is to provide an electric heating device with which the disadvantages mentioned can be avoided. It is also intended to provide a correspondingly improved production method.

This technical problem is solved according to the invention by the electric heating device with the features according to independent claims 1 and 2, the assembly with the features according to independent claim 14 and the method with the features according to independent claim 17. Further features and details of the invention emerge from the subclaims, the description and the drawings. Features and details that are described in connection with one of the aspects of the invention mentioned also always apply here in connection with the other aspects of the invention respectively, so that what is said with regard to one aspect of the invention also applies to the full extent in connection with the other aspects of the invention. With regard to the disclosure in relation to one of the aspects of the invention, reference is consequently also made to the full content of the disclosure in relation to the other aspects of the invention.

A fundamental feature of the present invention is that a thermal spraying process is used to produce at least one electrically conductive component and arrange it on the heating layer. A further fundamental feature of the present invention is in particular an electric heating system with a current flow perpendicular to the plane of the layer and/or with a current flow in the direction of the plane of the layer, which consists of at least one heating layer and at least one electrically conductive component, created for example by arc spraying, such as a contacting layer, and a method for the production thereof that can be automated.

Against this background, a novel construction is realized by the present invention for an electric heating system that is distinguished and delimited with respect to already existing electric heating systems by the following specifications in particular: in the case of the heating system according to the invention, the current flow takes place in particular in a kind of parallel circuit, that is to say perpendicularly to the surface area of the heating layer, and/or in the direction of the plane of the surface area of the heating layer. The contacting of the heating layer takes place by at least one, for example area-covering, electrically conductive component, for example a contacting layer, which is preferably created by arc spraying. The heating system according to the invention can be produced on a complexly three-dimensional, for example curved, surface that is shaped in any way desired. The heating system according to the invention has a great insensitivity to damage in comparison with existing heating systems. The temperature distribution of the heating system according to the invention is very homogeneous over the entire heating area. Also provided is a corresponding production method for such a heating system, which is distinguished in particular by the fact that it can be automated to a high degree.

According to the first aspect of the invention, an electric heating device is provided, having at least one first electrically conductive component, at least one heating layer and at least one second electrically conductive component, the first electrically conductive component and/or the second electrically conductive component being produced and/or arranged on the heating layer by means of a thermal spraying process.

The term arranging also includes here that the conductive component(s) is/are applied to the heating layer, or else connected to it.

This aspect of the invention relates in particular to the combination of thermal spraying and the heating layer.

The thermal spraying is in particular a surface coating process. It particularly involves melting off, initially melting or completely melting additional materials inside or outside a spray burner. The molten particles are accelerated and applied to the surface of the assembly to be coated, for example spun on. The assembly surface is in this case not melted, and is subjected to only very little thermal loading.

According to the second aspect of the invention, alternatively or in addition, an electric heating device is provided, having at least one first electrically conductive component, at least one heating layer and at least one second electrically conductive component, the electrically conductive components and the heating layer being arranged with respect to one another in such a way that a current flow perpendicularly to the plane of the heating layer and/or in the direction of the plane of the heating layer is realized or can be realized.

Consequently, various directions of the current flow are envisaged. In principle, this may take place in the direction of the plane of the heating layer, that is to say parallel to the plane of the heating layer. Or else it takes place perpendicularly thereto. In the first case, in the simplest embodiment the electrically conductive components, for example corresponding electrodes, lie at the peripheries, that is to say the edges, of the heating layer. The heating layer is in particular a heatable coating. If appropriate, however, strip-shaped electrically conductive components may also be provided somewhere within the heating layer. In the case of perpendicular current flow, the electrically conductive components, for example the electrodes, may be provided over the full surface area below and above the heating layer, so that the electrically conductive components merely have to overcome the distance dictated by the thickness of the heating layer.

According to the invention, an electric heating device is provided. This is a device by means of which assemblies that are in contact with the heating device can be heated. In this case, the heating device is formed as an electric heating device. This means that the heating device is electrically operated, heat being generated in particular on account of a current flow. For this purpose, a first and a second electrically conductive component are provided, by way of which this current flow is realized. The electrically conductive components may be formed for example metallically, for instance as metal layers. A heating layer is also provided. The invention is not restricted here to specific embodiments of the electrically conductive components and the heating layer. Some preferred, but not exclusive exemplary embodiments are described in more detail hereinafter.

According to the invention, it is also envisaged that the electrically conductive components and the heating layer are arranged in a particular way. According to the invention, they are arranged with respect to one another in such a way that a current flow perpendicularly to the plane of the heating layer and/or in the direction of the plane of the heating layer is realized or can be realized. This means that a kind of parallel circuit is realized. How specifically this can take place is explained in more detail in the description hereinafter, on the basis of preferred, but not exclusive examples.

Preferably, the first electrically conductive component is formed as an electrically conductive contacting layer and/or as an electrically conductive, in particular three-dimensional, substrate element. In this way, any desired three-dimensional structures can also be heated. For example, the electrically conductive component may be formed as a metal layer. If the component is formed as a contacting layer, it can be applied for example to a substrate element, as is described in particular in connection with the assembly according to the invention. In another configuration, the component itself may be formed as such a substrate element. A substrate element is in particular a carrier element that is suitable for carrying an electric heating device. In principle, such a substrate element is not restricted to specific sizes and/or forms. In a further configuration, the second electrically conductive component may be formed as an electrically conductive contacting layer.

For example, such an electrically conductive contacting layer may be formed as a single layer or as multiple layers. All that is important is that the contacting layer is electrically conducting. One possibility for specifically reducing mechanical stresses (in particular those that occur during production or in operation due to the different coefficients of thermal expansion) between the functional layers of the heating device, and consequently increasing the service life of the heating system, is to construct the contact layers, for example metallic contact layers, from different materials as a multilayer system. By the choice of suitable materials, both good electrical contacting and specific stress reduction can be ensured. A system comprising the materials copper and zinc or a system comprising the materials copper, tin and zinc may be mentioned here by way of example.

Preferably, the first electrically conductive component and/or the second electrically conductive component may be formed in an area-covering manner. Area-covering means here in particular that the contact elements cover at least a partial area of the heating area.

In a further configuration, the first electrically conductive component and/or the second electrically conductive component may take the form of an electrically conductive contacting pattern. In this case, the invention is not restricted to specific kinds and types of patterns. For example, a strip-shaped pattern may be realized.

In a preferred embodiment of the heating device according to the invention, the contacting layers may be created or formed as a kind of pattern, for example in a meandering manner. In this way, the flexibility of the heating system according to the invention is increased. Furthermore, possible differences in the coefficients of thermal expansion can be compensated by this contacting, and resultant mechanical stresses between the functional layers can be reduced or avoided. The functional layers are then in particular the heating layer and the two electrically conducting contacting layers.

The electric current may for example flow between the metal contacts parallel to the plane of the heating layer. The metal contacts may for example have a contacting pattern in the form of a comb structure. Here, current flows between the webs. A simple variant provides two parallel contacts. Contacts set up in an annular form may also be provided. Similarly, electrically conductive components, for example contacting layers, may be formed as rigid or flexible curved/curvable surface areas. Floating contacts are also possible.

With a uniform thickness of the heating layer, it is preferably envisaged that the contacts are parallel. They do not have to be straight. Contacts may be provided below or above the heating layer. Any other geometrical arrangement of the contacts requires a local layer thickness adaptation of the heating layer, which however is quite possible, particularly with modern printing processes.

In a further configuration, at least one first and at least one second electrically conductive component may be formed as an electrode, the electrodes having a different potential level.

One particular embodiment of the invention concerns coatings with a current flow parallel to the plane of the layer, that is to say in the direction of the plane of the layer. For this purpose, not full-area electrodes but instead electrode patterns, for example electrode strips, are applied, for example sprayed. For example, a rectangular surface area may be provided over contacting of opposite edges. More complicated surface areas, for example curved in one or two directions, with straight or curved peripheries, may be provided with optimized electrodes. In this case there does not have to be a restriction to two electrodes, but rather three or more electrodes may also be used. During operation, these electrodes must be at at least two different potential stages, for example a positive electrode in the middle of a surface area may be combined with two negative electrodes at the peripheries of the area. However, more than two potential stages are also possible, for example to be able to control the specific power in different parts of a surface area independently of one another. The optimum position and potential levels for the electrodes may be determined by trials and/or by simulations. As described further above, further electrodes, for example annular electrodes, may also be inserted into this arrangement. A further possible solution may be realized by two or more electrodes in regular, for example comb-like geometries. In each of the aforementioned cases, the current flows from one electrode to the other within the plane of the layer, that is to say parallel thereto.

The statements made with respect to substrates, grading of the electrodes and the construction of the electrodes from a number of materials also apply to this aspect of the invention. An example of this aspect of the invention is given by pipe heating, which is still to be described more precisely later.

Preferably, at least one first electrically conductive component and/or at least one second electrically conductive component may be formed in such a way that different temperature regions and/or heating zones are realized or can be realized in the heating layer. One advantage that is obtained by this embodiment is that, by the arrangement of the conductive components, the heating current flow can be influenced in such a way that different temperature regions or heating zones can be realized in the surface area to be heated.

Preferably, the heating layer may be formed at least in certain regions as a carbon-based heating layer, in particular as a heating layer based on carbon nano material or carbon micro material, for example in the form of a coating or an impregnation. It is also conceivable that a composition of some kind or other of carbon materials with carbon nano materials is used. Depending on the configuration, such heating layers consist in particular of a corresponding binder matrix and a carbon formulation made to match the respective application. On account of the outstanding conductivity, high heating power outputs can be realized with a harmless low voltage, it also being possible for uniform heat radiation to be realized, without so-called hotspots. For example, it may be envisaged that the heating layer is formed as a plastic doped with carbon material, for example as a polymer doped with carbon nano particles.

For example, the first electrically conductive component, the heating layer and the second electrically conductive component may be formed in the manner of a sandwich. Conductive components formed as conductive contacting layers then serve as area-covering contacting of the heating layer. The sandwich-like heating created in this way, in which a current flow transversely to the surface of the assembly is ensured, is distinguished in particular by the fact that it can be generated on any area geometry and topology, that is to say also on three-dimensional structures. This makes it possible also to heat complexly shaped assemblies and structures homogeneously.

Preferably, the first electrically conductive component, the heating layer and the second electrically conductive component may be connected to one another in such a way that a current flow perpendicularly to the plane of the coating of the heating device, in particular the heating layer, is realized or can be realized and/or that the first electrically conductive component, the heating layer and the second electrically conductive component are connected to one another in such a way that the electrically conductive components are provided at the sides of the heating layer. In this case, the current flow takes place in the direction of the plane of the heating layer.

It is conceivable that the contacting of the heating layer only takes place at the sides of the surface area to be heated, by the applying of contacting areas, for example the spraying on of contacting areas by means of arc spraying. In this case there is for example the possibility of providing pipes or pipe-like structures with a heating layer on the inner side and applying the contacting of this heating layer at the open ends of this pipe. This allows such structures to be heated easily and efficiently.

Preferably, the first electrically conductive component and/or the second electrically conductive component may be constructed in a graded manner. In order to minimize or avoid the development of mechanical stresses between the functional layers during the production and during the operation of the heating device according to the invention, there is the possibility of constructing the contacting layers in a graded manner. This means that, by a specific choice of the process parameters in the thermal application, for example spraying, of the contact layers, the properties, for example pore size, number of pores and the like, of the resultant layer are set in such a way that mechanical stresses can be compensated.

Preferably, the first electrically conductive component and/or the second electrically conductive component may have been applied/be applied to the heating layer by means of an application process, in particular by means of an arc spraying process. Arc spraying is a thermal spraying process. Of course, other thermal spraying processes apart from the arc spraying process may also be used according to the present invention. In principle, all thermal spraying processes are suitable for creating the electrically conductive component (in particular the first and/or second conductive component, such as the first and/or second contacting layer) of the heating devices according to the invention and/or of the assembly according to the invention (that is to say the heating system according to the invention), provided that metallic materials can be processed by them, and consequently metallic layers can be created on different substrates (in particular the heating layer of the heating devices according to the invention and/or the substrate element of the assembly according to the invention or substrates on which the heating layer or the substrate element is based). In the case of arc spraying, particularly electrically conducting spray materials are fed continuously toward one another at a specific angle. After igniting, an arc burns between the spray materials and melts off the spray material.

For example, arc spraying is distinguished by the fact that two wires are melted within the so-called spray burner by means of an arc (which may be generated in particular by applying an electric current). The molten particles produced in this way are accelerated by a carrier gas stream, and after the flying phase, impinge on the substrate surface to be coated, where the metallic layer is formed by the particles solidifying. The adhesion mechanism may in this case be based for the most part on a mechanical interlocking, but partly also on a partial welding of the substrate surface and the metal particles forming the layer.

The temperature of the molten particles is in each case dependent on the melting temperature of the material used in the thermal spraying (in particular arc spraying) and the material to be sprayed (i.e. spray material) and on the process parameters used, and has a direct influence on the thermal loading for the substrate to be coated.

The process parameters are advantageously set in such a way that damage to or destruction of the substrate used (in particular the heating layer of the heating devices according to the invention and/or the substrate element of the assembly according to the invention or substrates on which the heating layer or the substrate element is based) is avoided in the production and/or arrangement of the first and/or second conductive component (such as the first and/or second contacting layer) of the heating devices according to the invention and/or of the assembly according to the invention. For example, the process parameters are set in such a way that the thermal loading of the substrate remains minimal, in particular that the temperature of the substrate during the thermal spraying (in particular the arc spraying) is a maximum of 200° C. (such as ≤195° C., ≤190° C., ≤185° C., ≤180° C., ≤175° C., ≤170° C., ≤165° C., ≤160° C., ≤155° C., ≤150° C.). Further process parameters that may have an influence on the thermal loading of the substrate are the intensity of the electric current (with the aid of which the arc is generated), the pressure of the carrier gas, the traversing speed (that is to say the speed at which the spray burner is moved in relation to the substrate or the substrate is moved in relation to the spray burner during the thermal spraying) and the spraying distance (that is to say the distance between the spray nozzle of the spray burner and the nearest point of the substrate surface, measured along the spray jet axis). A low current intensity (for example 30-100 A, such as 30-95 A, 30-90 A, 30-80 A, 35-75 A, 40-70 A, 45-70 A), a moderate carrier gas pressure (for example 1.0-3.0 bar, such as 1.1-2.9 bar, 1.2-2.8 bar, 1.3-2.7 bar, 1.4-2.6 bar, 1.5-2.5 bar), a high traversing speed (for example ≥450 mm/s, such as ≥460 mm/s, ≥470 mm/s, ≥480 mm/s, ≥490 mm/s, ≥500 mm/s, ≥510 mm/s, ≥520 mm/s, ≥530 mm/s, ≥540 mm/s, ≥550 mm/s, ≥560 mm/s, ≥570 mm/s, ≥580 mm/s, ≥590 mm/s, ≥600 mm/s) and a spraying distance in the range of 50-400 mm (for example 60-390 mm, such as 70-380 mm, 80-360 mm, 90-350 mm, 100-300 mm, 105-290 mm, 110-280 mm, 120-270 mm, 125-260 mm, 130-250 mm) are advantageously used for the thermal spraying.

For example, the production and/or arrangement of the first and/or second conductive component (such as the first and/or second contacting layer) of the heating devices according to the invention and/or of the assembly according to the invention may take place at a current intensity of 30-80 A, a carrier gas pressure of 1.5-2.5 bar, a traversing speed of >500 mm/s and a spraying distance of 100-300 mm.

The layer morphology and properties of the layers (in particular metallic layers) created on the substrate (in particular the heating layer of the heating devices according to the invention and/or the substrate element of the assembly according to the invention) by thermal spraying (in particular arc spraying) may be influenced furthermore by the use of different kinds of carrier gas (for example compressed air, nitrogen, argon) and/or different nozzle geometries of the spray burner. Specific nozzle geometries also make possible here the use of a so-called secondary gas stream, which has an effect in particular on the size and speed of the molten spray particles.

By means of the thermal spraying process (in particular the arc spraying process), metallic layers with graded properties can be created (that is to say produced and/or arranged) in an advantageous way on different substrates. In particular, it is possible by the production and/or arrangement of the first and/or second conductive component (such as the first and/or second contacting layer) of the heating devices according to the invention and/or of the assembly according to the invention as a multilayer system (for example from different spray materials) to reduce specifically mechanical stresses (in particular those that occur during production or in operation due to the different coefficients of thermal expansion) between the functional layers of the heating devices according to the invention and/or of the assembly according to the invention, and consequently increase the service life of the heating devices according to the invention and/or of the assembly according to the invention.

One particular advantage of the thermal spraying process (in particular the arc spraying process) is the possibility of combining two different spray materials and thereby creating so-called pseudo-alloys. In particular in the case of layers constructed as multiple layers (such as for example of the first and/or second conductive component, in particular the first and/or second contacting layer, of the heating devices according to the invention and/or of the assembly according to the invention), a smooth transition of the properties between the individual materials (such as for example between the substrate element and the first conductive component and/or between the first and/or second conductive component and the heating layer) can consequently be realized.

As an example, mention is made at this point of a layer system comprising the spray materials copper and zinc. A layer of zinc is created as the first layer. This has the function of reducing mechanical stresses occurring. The second layer consists of a so-called pseudo-alloy of zinc and copper. This is created (that is to say produced and/or arranged) by using different kinds of spray materials (for example a wire of one metal or alloy and a further wire of another metal or alloy) simultaneously during the thermal spraying. For example, a zinc wire and a copper wire may be used simultaneously to create a layer of a pseudo-alloy of zinc and copper. A copper layer is created as a third layer of the layer system. This allows good electrical contacting to be ensured. It is of course also possible in this way to construct multilayer systems which consist of three or more spray materials (for example a multilayer system comprising a layer of Zn, a layer of Sn and a layer of Cu).

In principle, all conductive materials, in particular those that can take the form of wire, such as corresponding metals (for example copper, zinc, tin, aluminum, silver) or corresponding alloys (for example brass) are suitable as spray materials that can be used in the thermal spraying process (in particular the arc spraying process). Of course, materials that have a high electrical conductivity, such as copper, brass, aluminum or silver, are advantageous.

The layer thicknesses of the layers created (that is to say produced and/or arranged) by thermal spraying (such as for example the first and/or second conductive component, in particular the first and/or second contacting layer, of the heating devices according to the invention and/or of the assembly according to the invention) lie in the range of 0.05-0.5 mm. Depending on the application of the heating devices according to the invention and/or of the assembly according to the invention (that is to say the heating system according to the invention), the flexibility of the system as a whole can also be influenced thereby.

Both electrically conductive and electrically insulating materials are suitable as a substrate for the thermal spraying (in particular the arc spraying). Examples of electrically conductive materials are steel, aluminum or copper. Thermoplastic or thermosetting polymers or ceramic materials may be used as electrically insulating materials. Here it should be noted that comparatively low-melting, temperature-sensitive and/or foamed thermoplastic polymers (such as for example polypropylene (PP), expanded polypropylene (EPP), polystyrene (PS), expanded polystyrene (EPS)) can also be provided with metallic layers by means of the thermal spraying process (in particular the arc spraying process). This is made possible by the thermal loading of the substrate being substantially dependent on the temperature of the molten spray particles. This particle temperature is advantageously always less than or equal to the melting temperature of the spray material used. The procedure for coating such temperature-sensitive substrates is to create a first metallic layer of a spray material that has a melting temperature that lies a maximum of 300° C. (for example a maximum of 290° C., a maximum of 280° C., a maximum of 270° C., a maximum of 260° C., a maximum of 250° C., a maximum of 240° C., a maximum of 230° C., a maximum of 220° C., a maximum of 210° C., a maximum of 200° C.) above the thermal loading of the substrate (for example zinc; melting temperature: 419.5° C.). This first layer serves the purpose of protecting the substrate material from any further thermal effect. In a further method step, a layer of any desired metallic spray material (for example copper; melting temperature: 1084.6° C.) may be created on this first metallic layer. The heat of the molten spray particles from the second spray material impinging on the substrate is in this case absorbed and homogenized by the first metallic layer, whereby thermal damage to the actual substrate material is avoided. By this procedure it is also possible to construct multilayer systems, as described above.

Different variants of an embodiment are possible by the construction of the heating device according to the invention, in particular with functional layers lying one on top of the other in the form of contacting layers and a heating layer, for example a flexible film-based heating system, a direct construction of the heating system on structures that are not electrically conducting and have complex three-dimensional geometries, or a direct construction of the heating system on structures that are electrically conducting and have complex three-dimensional geometries.

The present invention relates in particular to the combination of thermally sprayed contacts and a heatable coating. One embodiment of the invention concerns the current flow perpendicularly to the plane of the layer.

According to the third aspect of the invention, an assembly is provided, having at least one electric heating device according to the invention as described above, so that in this respect reference is made to the full content of the statements made above in relation to the heating device. A substrate element on which the heating device is arranged is also provided.

The substrate element may preferably be formed as a three-dimensional structure. This allows three-dimensional structures formed in any way desired, even complicatedly constructed three-dimensional structures, to be heated.

For example, the heating device according to the invention may be constructed on a substrate element in the form of a film-like carrier material. The advantage of this embodiment is that in this way a flexible heating system that can be adapted individually to the respective application can be generated. In the case of this variant, polymer films especially come into consideration as substrate films. However, it is likewise conceivable to use a metallic film as the carrier material. In this case there is no need for the construction of a first contacting layer, since the electrically conductive substrate itself can act as full-area contacting. In this embodiment of the heating device according to the invention there is the advantage over conventional heating films that on the one hand the heating system can be produced in a surface area shaped in any way desired, on the other hand the heating system according to the invention in this embodiment can also be produced as roll stock, which can be brought into the desired form by cutting to size. The flexibility of the heating system consequently allows two-dimensionally curved structures to be heated.

In another configuration, the heating device according to the invention is constructed directly on a solid, nonconductive carrier structure, for example a plastic assembly. The advantage of this embodiment is that the heating system can be created directly on complex, three-dimensionally shaped structures or assemblies. This makes a very high adaptability to a wide variety of applications possible and represents a considerable advantage over all heating systems that are available on the market.

In a further configuration, the first electrically conductive component of the heating device may be formed as the substrate element of the assembly. This exemplary embodiment is obtained for example by the use of electrically conductive structures or assemblies as the carrier for the heating device according to the invention. This gives rise to the possibility of using the carrier structure itself for introducing current into the heating layer, in particular for contacting. This significantly reduces the production effort, since only one contact layer has to be created.

The direct contact of the heating system with the assembly to be heated makes an optimal heat transfer possible, whereby heat losses are avoided and the overall energy efficiency of the heating is increased.

According to a fourth aspect of the present invention, a method for producing an electric heating device and/or for producing an assembly is provided, which method is characterized by the following steps:

a) a first electrically conductive component is produced or provided;

b) a heating layer is arranged on the first electrically conductive component;

c) a second electrically conductive component is produced or provided;

d) the heating layer is arranged on the second electrically conductive component;

e) the first electrically conductive component and/or the second electrically conductive component are produced and/or arranged on the heating layer by means of a thermal spraying process, and/or the electrically conductive components and the heating layer are arranged with respect to one another in such a way that a current flow perpendicularly to the plane of the heating layer and/or in the direction of the plane of the heating layer is realized or can be realized. In particular, in this aspect according to the invention, a method for producing an electric heating device and/or for producing an assembly is provided, which method is characterized by the following steps: a) producing or providing a first electrically conductive component; b) arranging a heating layer on the first electrically conductive component; c) producing or providing a second electrically conductive component; d) arranging the second electrically conductive component on the heating layer, the first electrically conductive component and/or the second electrically conductive component being produced and/or arranged on the heating layer by means of a thermal spraying process, and/or the electrically conductive components and the heating layer being arranged with respect to one another in such a way that a current flow perpendicularly to the plane of the heating layer and/or in the direction of the plane of the heating layer is realized or can be realized.

The method is preferably designed for producing an electric heating device according to the invention as described above and/or for producing an assembly according to the invention as described above, so that reference is made to the full content of the corresponding statements made further above.

Preferably, the first electrically conductive component may be applied to a substrate element, in particular by means of an application process, preferably by means of a thermal spraying process, for instance an arc spraying process, in particular an arc spraying process as described above for the heating devices according to the invention of the first and second aspects. In this step for producing a heating device according to the invention, a contacting layer, for example a metal layer, is applied to any desired carrier substrate. In another configuration, the substrate element to which the heating device is applied may be formed as an electrically conductive component.

Preferably, the heating layer, here a layer that can be heated by electric current, may be applied to the first electrically conductive component by means of an application process, in particular by means of a spraying process, a roll-coating process or a blade-coating process.

In a further configuration, the second electrically conductive component may be applied to the heating layer by means of an application process, in particular by means of a thermal spraying process, for instance an arc spraying process, in particular an arc spraying process as described above for the heating devices according to the invention of the first and second aspects.

For the invention as a whole it should be emphasized as an advantage over other solutions for providing contacting that electrical contactings that can operate at high temperatures can be applied at room temperature. Many other electrical contactings are not suitable for high temperatures (for example 500° C.) because they are for example adhesively applied and the adhesive used does not have sufficient temperature resistance. Other solutions, for example inorganically based conductive lacquers, must be sintered at high temperature in order to achieve their properties. On the other hand, the thermally sprayed contactings are stable up to very high temperatures, but can be applied at room temperature. The method is of particular interest for high temperature applications if contacts can no longer be adhesively applied or a baking of conductive pastes at 600-900° C. is not feasible. In the present case, contacts that can operate at high temperatures can be applied at room temperature, which is a considerable advantage. There is good adhesive bonding in the entire temperature range.

Preferably, furthermore, a heating device according to the invention as described above and/or an assembly according to the invention as described above and/or a method according to the invention as described above is characterized in that at least one or more of the features mentioned in the claims, the description, the figures and the examples is/are provided.

The electric heating device according to the present invention and/or the assembly according to the present invention and/or the production method according to the present invention can be used in very many application areas. The following applications may be mentioned for example:

- mold making
  - heating of molds for producing fiber composite materials
- automotive
  - seat heating
  - side wall heating
- aeronautical engineering
  - use for deicing airfoils
- wind turbine generator systems
  - heating coating of wind vanes to prevent ice formation
- rail transport
  - heating of the driver's cab and passenger compartment
  - side wall heating
- domestic engineering
  - floor or wall heating
  - heating for sanitary installations The invention is explained in more detail below on the basis of preferred exemplary embodiments with reference to the accompanying drawings, in which:

Figure 1:
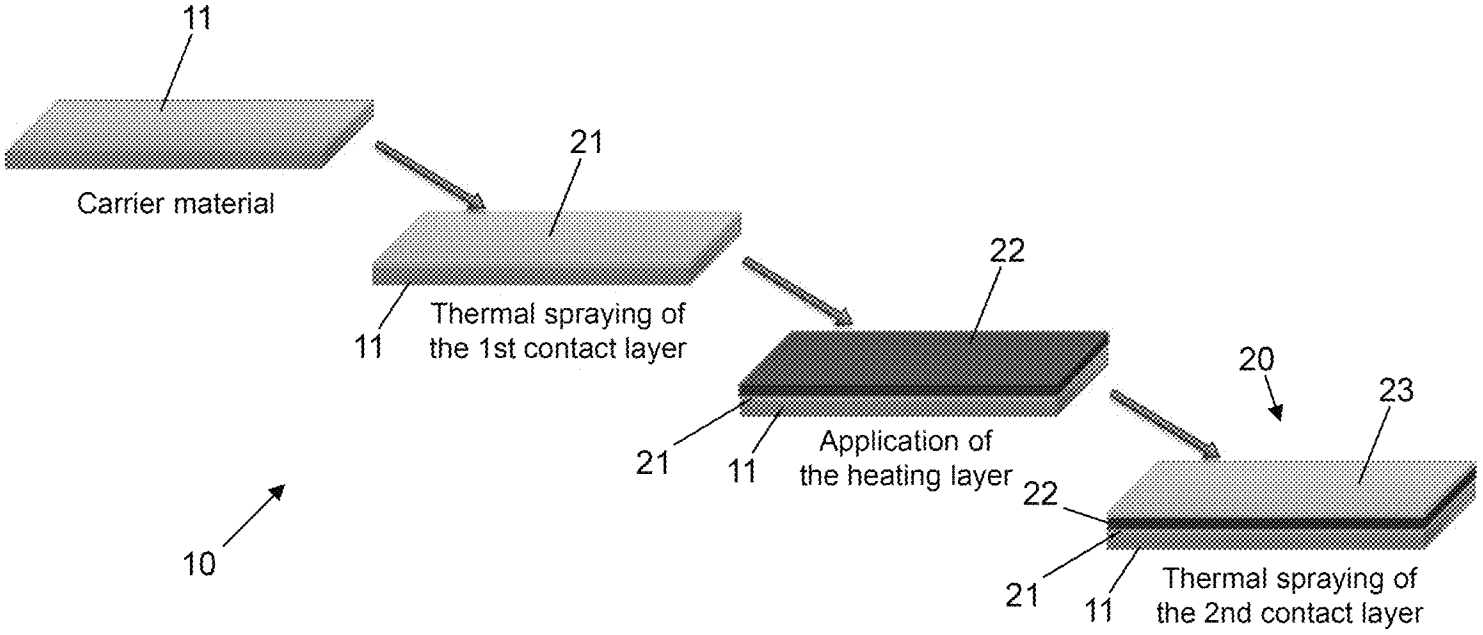
FIG. 1 shows method steps for constructing an electric heating device according to the invention.

In the figures, an assembly 10 according to the invention, which has a substrate element 11, is represented. The assembly also has an electric heating device 20. The electric heating device 20 has a first conductive component 21 in the form of a contacting layer, a heating layer 22, and a second conductive component 23 in the form of a contacting layer.

The heating device 20 according to the invention is constructed by means of a series of coating operations. The functionality is achieved in this case by the combination of at least one heating layer 22, based on polymers doped with carbon nano particles, and a contacting of this heating layer 22 by at least one second conductive component 23, which is in the form of a metal layer and is applied in an area-covering manner.

The method of the so-called arc spraying, which is included in the group of thermal spraying processes, is used for creating this metallic contacting layer.

In the first step for producing a corresponding assembly 10, a first electrically conductive component 21, for example a metallic contacting layer, is applied by means of arc spraying to any desired substrate element 11, for example a carrier substrate. After that, a coating that can be heated by electric current, the heating layer 22, is applied to the conductive component 21 created. The application of this heating layer 22 may take place by various application processes, such as for example spraying, roll coating or blade coating. In the third method step, a second conductive component 23, for example a metallic contacting layer 23, is applied to the heating layer 22. The method steps are represented in FIG. 1.

Figure 2:
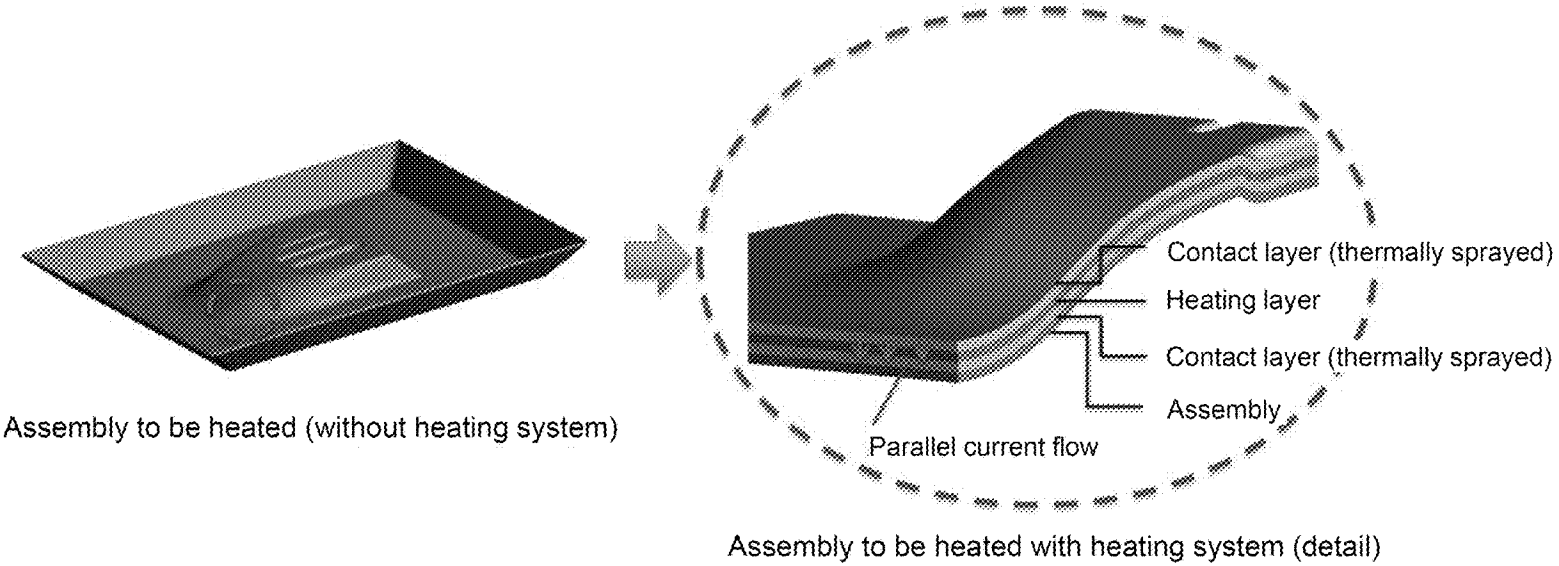
FIG. 2 shows a homogeneous heating of any desired forms by creating the heating device directly on a complexly shaped assembly.

The contacting layers created serve as area-covering contacting of the heating layer 22. The sandwich-like heating created in this way, in which a current flow transversely to the surface of the assembly is ensured, is distinguished by the fact that it can be generated on any area geometry and topology, that is to say also on three-dimensional structures. This makes it possible also to heat complexly shaped assemblies and structures homogeneously, as shown by way of example in FIG. 2.

In principle, three different variants of an embodiment are possible by the construction of the assembly according to the invention, or of the heating device according to the invention, with functional layers lying one on top of the other:

1. A flexible film-based heating system
2. Direct construction of the heating system on structures that are not electrically conducting and have complex three-dimensional geometries
3. Direct construction of the heating system on structures that are electrically conducting and have complex three-dimensional geometries.

The variants of an embodiment mentioned are briefly described below.

EXEMPLARY EMBODIMENT 1: A FLEXIBLE, FILM-BASED HEATING SYSTEM

Figure 3:
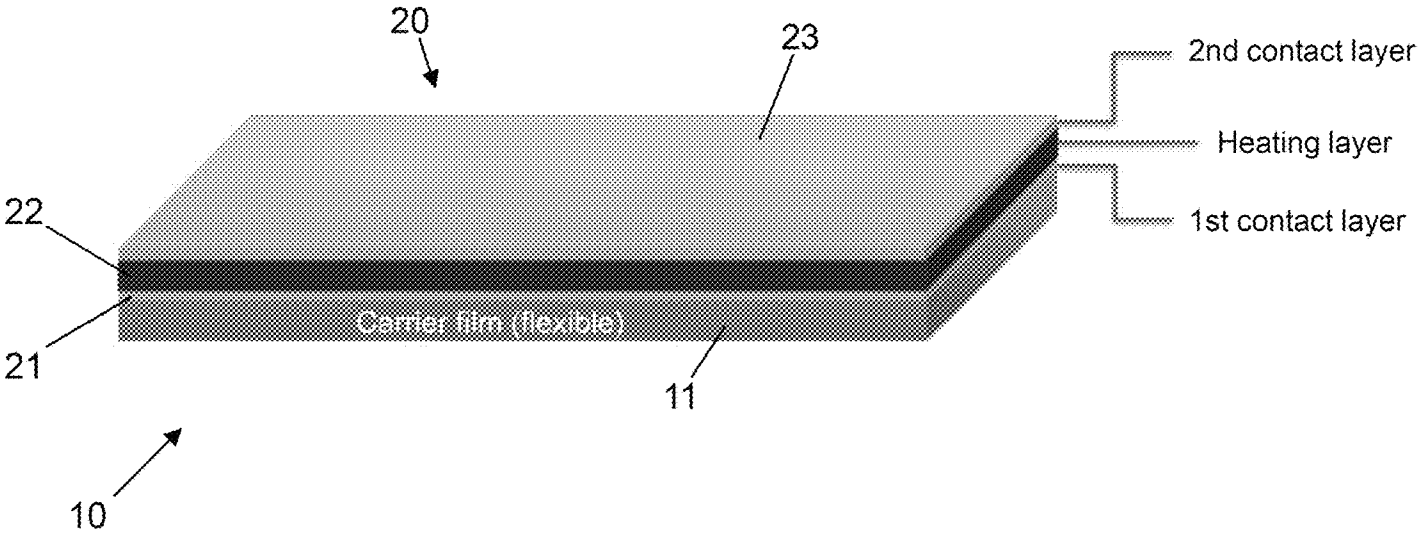
FIG. 3 shows a flexible, film-based heating device.

In the embodiment represented in FIG. 3, the heating device according to the invention is constructed on a film-like substrate element 11 as a carrier material. The advantage of this embodiment is that in this way a flexible heating system that can be adapted individually to the respective application can be generated. In the case of this variant, polymer films especially come into consideration as substrate films. However, it is likewise conceivable to use a metallic film as the carrier material. In this case there is no need for the first method step, that is to say the construction of the first electrically conductive component, since the electrically conductive substrate itself can act as full-area contacting. Then the first conductive component 21, the heating layer 22 and the second conductive component 23 are applied one after the other to the substrate element 11.

In this embodiment there is the advantage over conventional heating films that on the one hand the assembly 10 can be produced as a heating system in a surface area shaped in any way desired; on the other hand the heating system according to the invention in this embodiment can also be produced as roll stock, which can be brought into the desired form by cutting to size. The flexibility of the heating system consequently allows two-dimensionally curved structures to be heated.

EXEMPLARY EMBODIMENT 2: DIRECT CONSTRUCTION OF THE HEATING SYSTEM ON STRUCTURES THAT ARE NOT ELECTRICALLY CONDUCTING AND HAVE COMPLEX THREE-DIMENSIONAL GEOMETRIES

Figure 4:
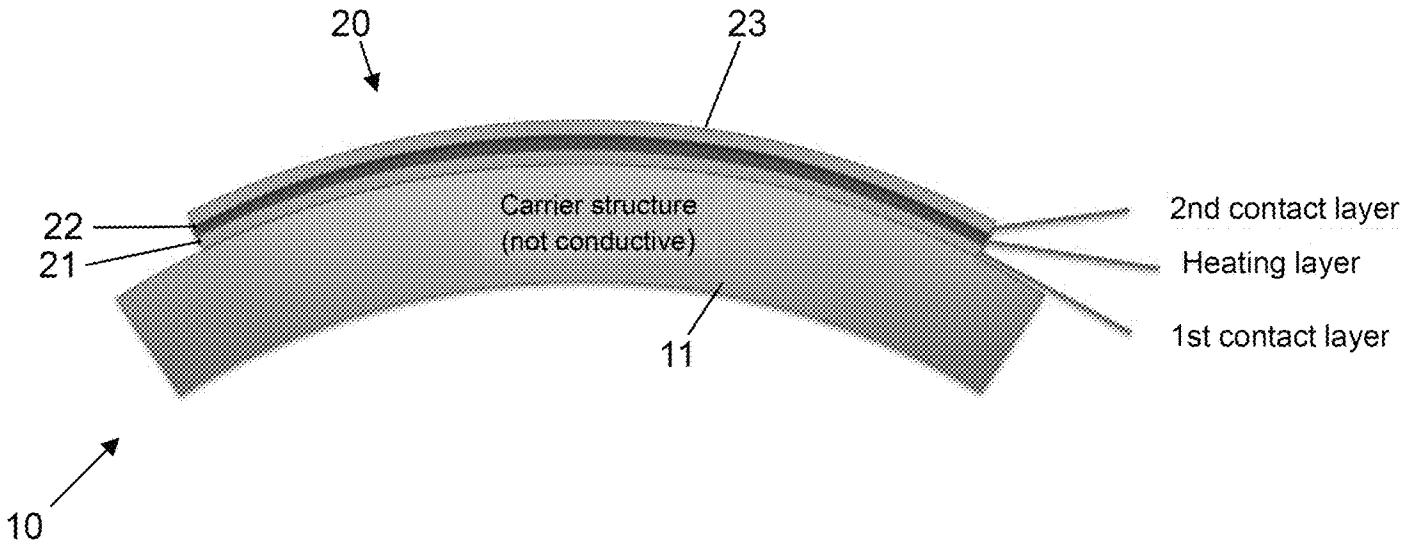
FIG. 4 shows a heating device for substrate elements that are not electrically conductive and have complex geometries.

In this embodiment according to FIG. 4, the heating device 20 according to the invention is constructed directly on a solid, nonconductive carrier structure, which represents the substrate element 11, for example a plastic part. The construction takes place in this case in a way analogous to the exemplary embodiment in FIG. 3, and so a total of 3 layers are created on the substrate element 11 as the carrier structure.

The advantage of this embodiment is that the assembly 10, which may be a heating system, can be created directly on complex, three-dimensionally shaped structures or assemblies. This makes a very high adaptability to a wide variety of applications possible and represents a considerable advantage over all heating systems that are available on the market.

EXEMPLARY EMBODIMENT 3: DIRECT CONSTRUCTION OF THE HEATING SYSTEM ON STRUCTURES THAT ARE ELECTRICALLY CONDUCTING AND HAVE COMPLEX THREE-DIMENSIONAL GEOMETRIES

Figure 5:
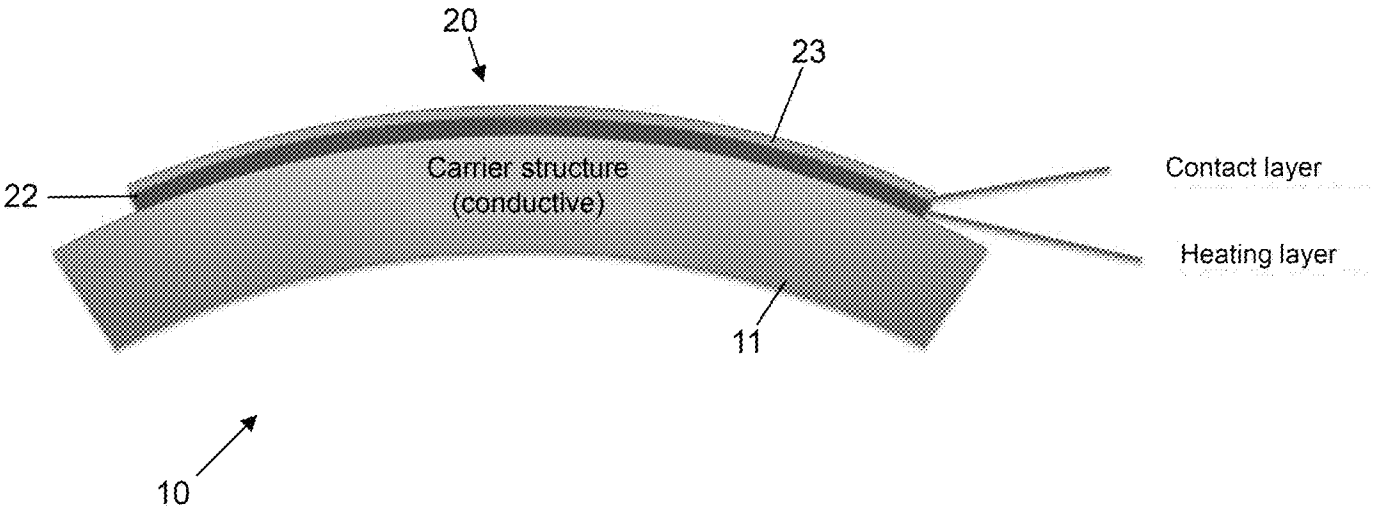
FIG. 5 shows a heating device for electrically conductive substrate elements with complex geometries.

A further exemplary embodiment, which is represented in FIG. 5, is obtained by the use of electrically conductive structures or assemblies as the substrate element 11 for the heating device 20 according to the invention. This gives rise to the possibility of using the substrate element 11 itself as the electrically conductive component 21 for introducing current into the heating layer 22, or for contacting. This significantly reduces the production effort, since only one electrically conductive component 23 has to be created.

The direct contact of the heating device in the variants of the embodiment according to FIGS. 4 and 5 with the assembly to be heated makes an optimal heat transfer possible, whereby heat losses are avoided and, altogether, the energy efficiency of the heating is increased.

Figure 6:
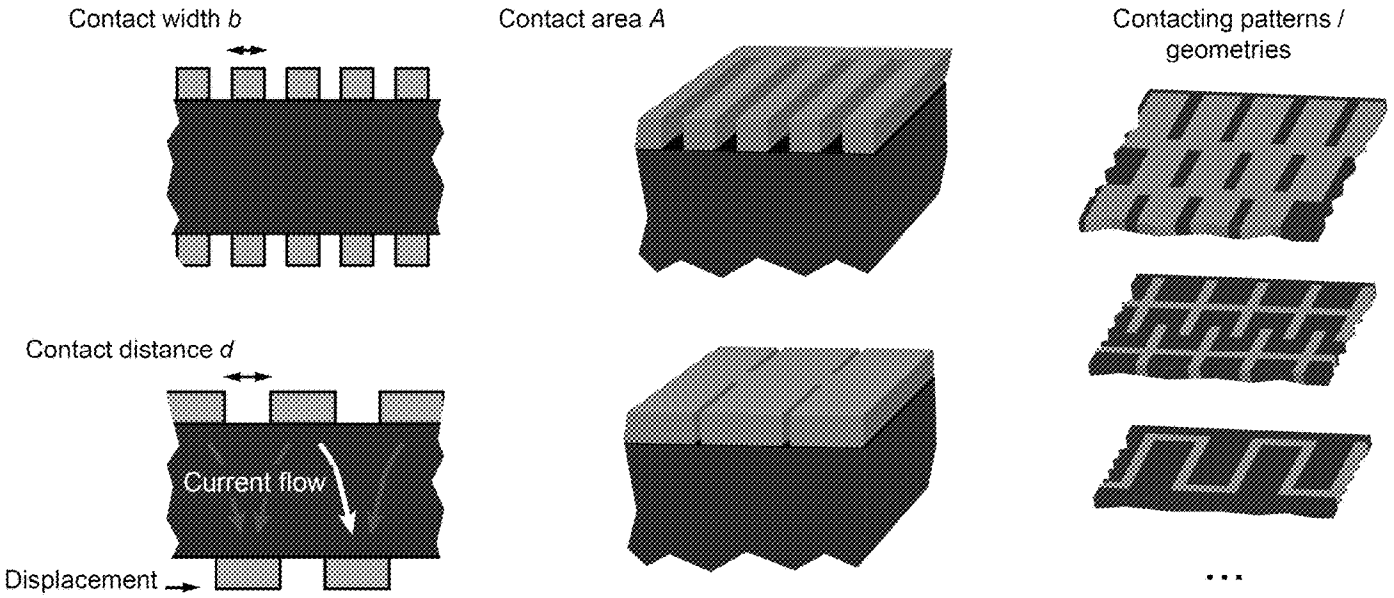
FIG. 6 shows various patternings of electrically conductive components.

In a further advantageous embodiment of the heating device according to the invention, the electrically conductive components, for example the metallic contacting layers, can be created as a kind of pattern, for example in a meandering manner. Various exemplary embodiments are represented in FIG. 6. In this way, the flexibility of the heating device according to the invention is increased. Furthermore, possible differences in the coefficients of thermal expansion can be compensated by this contacting, and resultant mechanical stresses between the functional layers can be reduced or avoided. A further advantage that is obtained by this embodiment is that, by the arrangement of the contact areas, the heating current flow can be influenced in such a way that different temperature regions or heating zones can be realized in the surface area to be heated.

Figure 7:
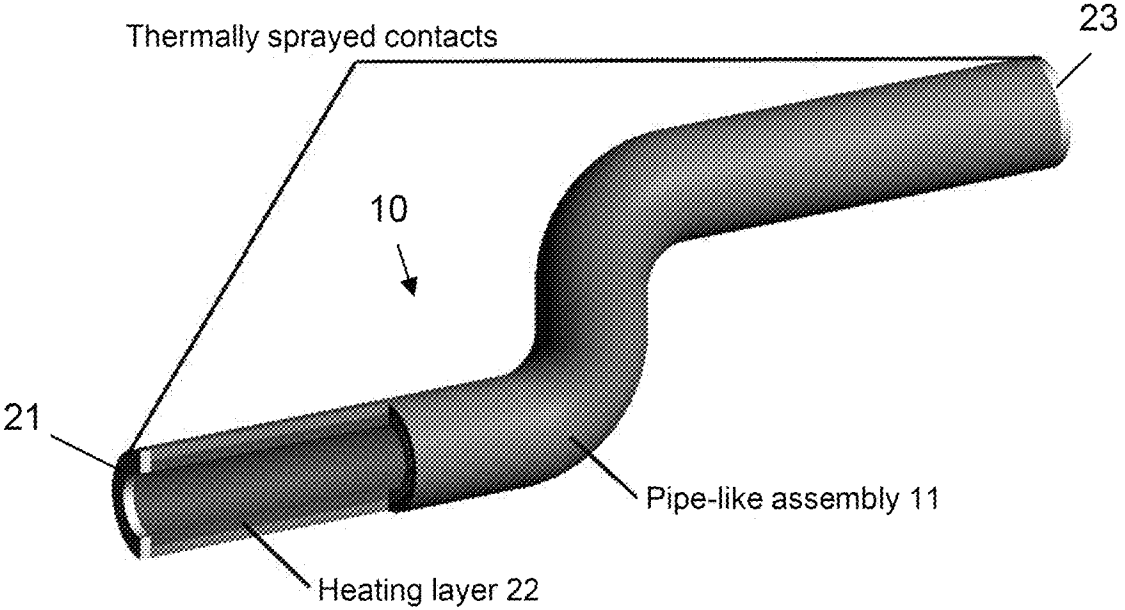
FIG. 7 shows an exemplary embodiment of the two-sided contacting of a heating layer by thermal arc spraying.

It is likewise conceivable that the contacting of the heating layer 22 only takes place at the sides of the surface area to be heated in the form of a substrate element 11, by the spraying on of electrically conductive components 21, 23 in the form of contacting areas by means of arc spraying. In this case there is for example the possibility of providing pipes or pipe-like structures with a heating layer 22 on the inner side and applying the contacting of this heating layer at the open ends of this pipe by means of arc spraying. This allows such structures to be heated easily and efficiently. A corresponding example of this is represented in FIG. 7.

In order to minimize or avoid the development of mechanical stresses between the functional layers during the production and during the operation of the heating device according to the invention, there is the possibility of constructing the metallic contacting layers in a graded manner. This means that, by a specific choice of the process parameters in the thermal spraying of the contact layers, the properties, for example pore size, number of pores, of the resultant metallic layer are set in such a way that mechanical stresses can be compensated.

Figure 8:
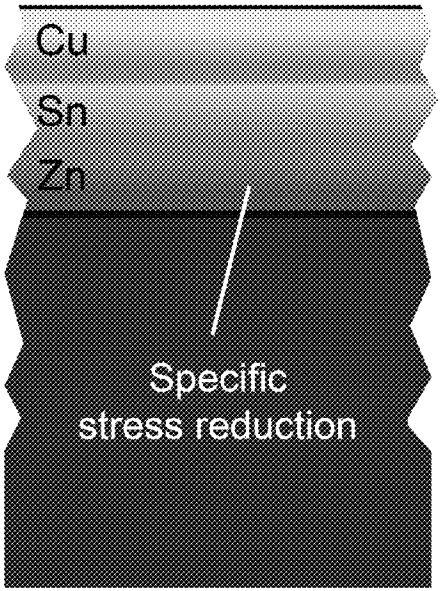
FIG. 8 shows specific stress reduction by multilayer systems.

A further possibility for specifically reducing mechanical stresses between the functional layers, and consequently increasing the service life of the heating system, is to construct the metallic contact layers from different materials as a multilayer system. By the choice of suitable materials, both good electrical contacting and specific stress reduction can be ensured. A system comprising the materials copper, tin and zinc may be mentioned here by way of example. An example of this is represented in FIG. 8.

In FIGS. 9 to 12, electric heating devices with various contact geometries are represented. Here, the current always flows parallel to the plane of the heating area 22 between the electrically conductive components 21, 23 in the form of metal contacts, at which there is a difference in potential P1-P2.

Figure 9:
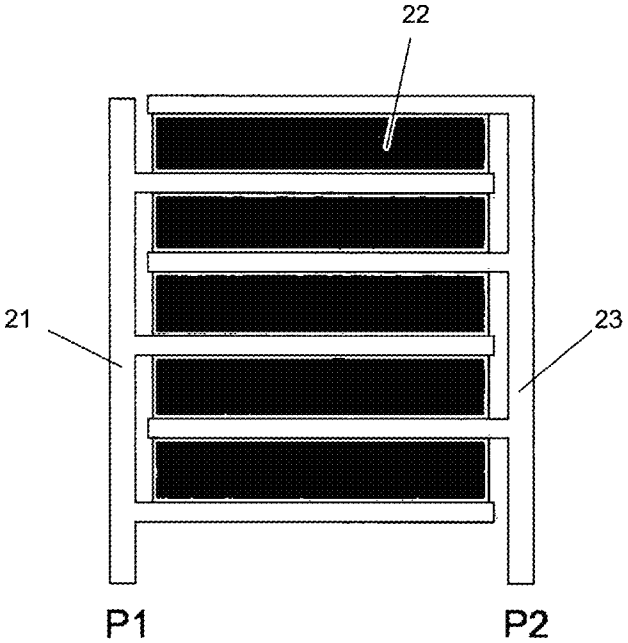
FIGS. 9 to 13 show exemplary embodiments of various contacting geometries.

In FIG. 9, a comb structure is represented. The current flows between the webs. Such a configuration is suitable for example for large surface areas, a floor, a wall, mold making, machine/toolmaking. It goes without saying that, in another configuration, the heating layer may also be drawn out beyond the ends of the webs up to the corresponding conductive component, which for example represents a counter electrode, so that the surface area between the electrically conductive components, which are for example electrodes, is completely coated.

Figure 10:
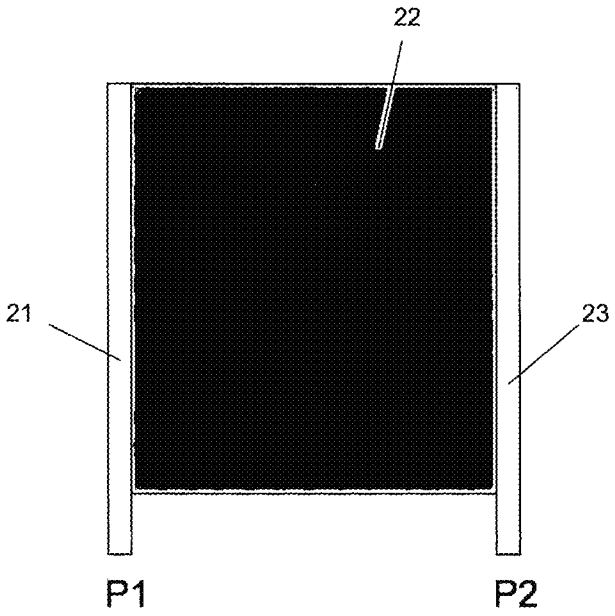

FIG. 10 shows a simple variant with two parallel contacts. Such a configuration is suitable for small to medium surface areas, automotive engineering, aeronautical engineering, mold making, machine/toolmaking.

Figure 11:
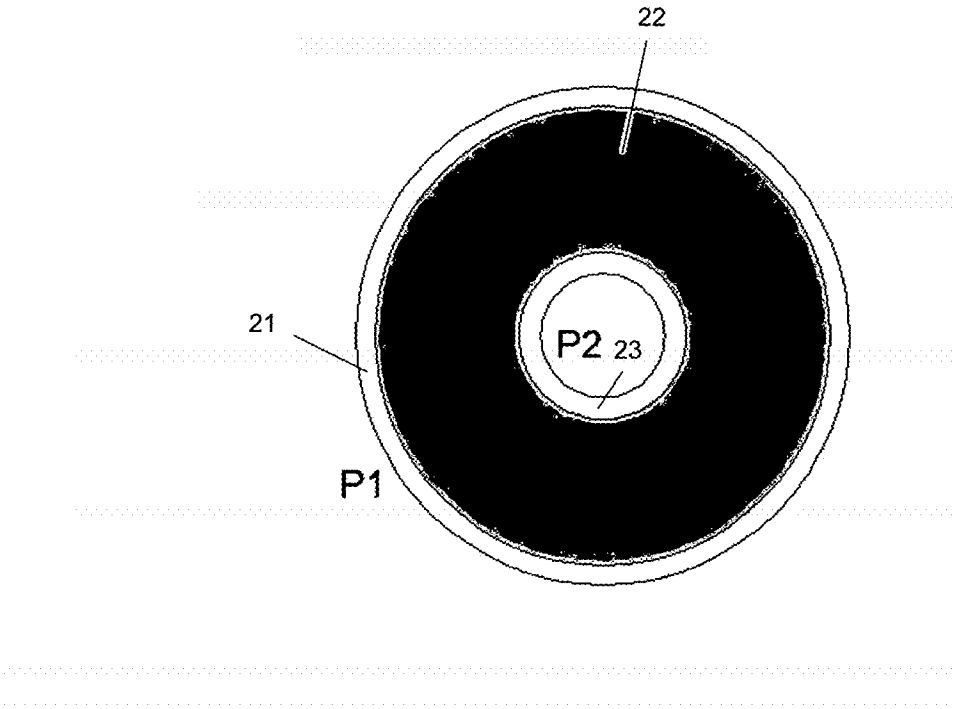

FIG. 11 shows a variant with contacts set up in an annular form. The current flow takes place between the two ring electrodes. This configuration is suitable for example for vessels, machine/toolmaking. However, there does not have to be a ring. A full-area circle may also be used.

Figure 12:
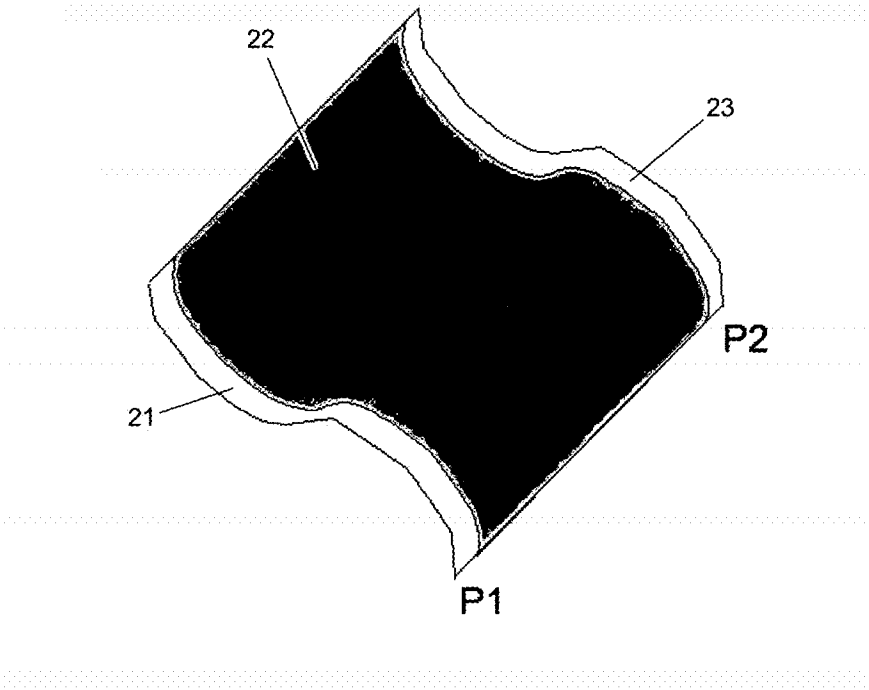

FIG. 12 shows a variant with rigid or flexible curved/curvable surface areas, such as metal sheets, films, textiles and the like. This configuration is suitable for example for applications that are described in connection with FIGS. 9 to 13. If this exemplary embodiment is conceptually taken further, it is also possible to imagine for example a pipe that is contacted at both ends or longitudinally, for instance by roll coating.

Figure 13:
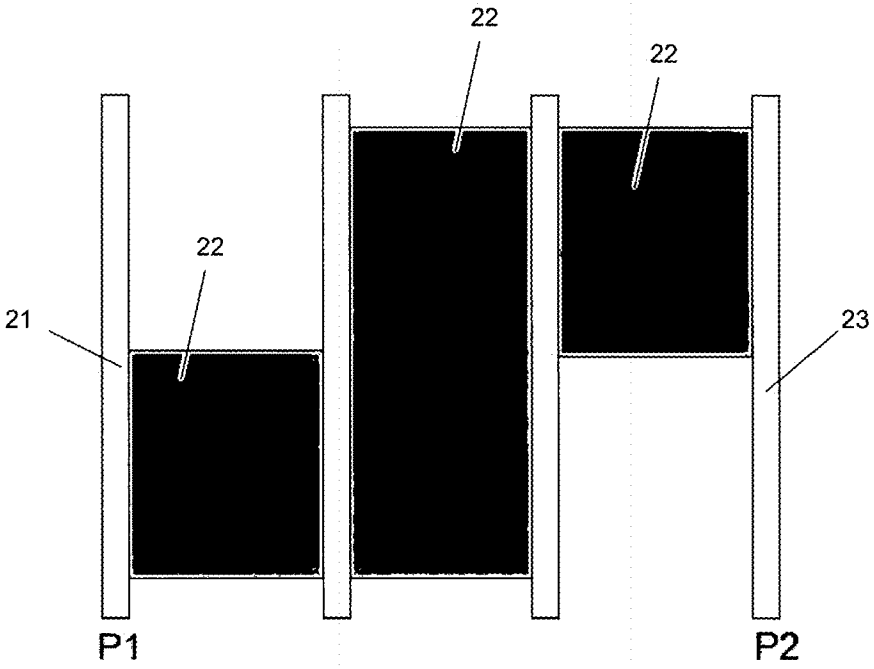

In FIG. 13, a variant with "floating" contacts for potential distribution in the case of more complicated surface areas is represented. Such a configuration can be used for example for floors in vehicles, for instance rail vehicles, shipping, and the like. In the case of the embodiment represented in FIG. 13, there may also be a potential at the floating contacts.

The applying of contacts in the interior of pipes, vessels, tubes of any size can likewise be realized.

A requirement for the uniform thickness of the heating layer is that the contacts are parallel. They do not have to be straight. Contacts may be provided below or above the heating layer. Any other geometrical arrangement of the contacts requires a local layer thickness adaptation of the heating layer, which however is quite possible with modern printing processes.

LIST OF REFERENCE SIGNS

10 Assembly
11 Substrate element
20 Electric heating device
21 First electrically conductive component (first contacting layer)
22 Heating layer
23 Second electrically conductive component (second contacting layer)
P1 Potential
P2 Potential

The invention claimed is:

1. A method for producing an electric heating device (20), comprising the following steps:

producing or providing a first electrically conductive component (21);

applying the first electrically conductive component (21) onto a substrate element (11), whereby the substrate element (11) is at least one of a temperature-sensitive polymer and a foamed thermoplastic polymer;

arranging a heating layer (22) on the first electrically conductive component (21), wherein the heating layer (22) is formed at least in certain regions as a carbon-based heating layer;

producing or providing a second electrically conductive component (23);

arranging the second electrically conductive component (23) on the heating layer (22), at least one of the first electrically conductive component (21) and the second electrically conductive component (23) being multiple layers and being at least one of produced and arranged on the heating layer (22) by means of a thermal spraying process, and comprising a first metallic layer of a spray material that has a melting temperature that lies a maximum of 300° C. above the thermal loading of the substrate material (11) and comprising a layer of a further spray material selected from copper, brass and aluminum.

2. The method as claimed in claim 1, wherein the first electrically conductive component (21) is applied to the substrate element (11) by means of an application process.

3. The method as claimed in claim 1, wherein the heating layer (22) is applied to the first electrically conductive component (21) by means of an application process.

4. The method as claimed in claim 1, wherein the second electrically conductive component (23) is applied to the heating layer (22) by means of an application process.

5. The method as claimed in claim 2, wherein the application process comprises an arc spraying process.

6. The method as claimed in claim 3, wherein the application process comprises a spraying process, a roll-coating process or a blade-coating process.

7. The method as claimed in claim 4, wherein the application process comprises an arc spraying process.

8. An electric heating device (20) made by the process of claim 1.

9. An assembly having an electric heating device (20) made by the process of claim 2.

10. The method as claimed in claim 1, wherein the electrically conductive components (21, 23) and the heating layer (22) are arranged with respect to one another in such a way that a current can flow in a direction at least one of perpendicular to a plane of the heating layer (22) and in the direction of the plane of the heating layer (22).

* * * * *